US006305638B1

(12) United States Patent
Rodriguez

(10) Patent No.: US 6,305,638 B1
(45) Date of Patent: Oct. 23, 2001

(54) SELF-LOCKING CORE AND SHAFT ASSEMBLY

(75) Inventor: Peter A. Rodriguez, Jacksonville, FL (US)

(73) Assignee: Sandar Industries, Inc., Atlantic Beach, FL (US)

( * ) Notice: Subject to any disclaimer, the term of this patent is extended or adjusted under 35 U.S.C. 154(b) by 0 days.

(21) Appl. No.: 09/421,704

(22) Filed: Oct. 20, 1999

(51) Int. Cl.[7] ..... B65H 75/18

(52) U.S. Cl. ..... 242/599.4; 242/530.4; 242/611.2

(58) Field of Search ..... 242/599.1, 599.4, 242/611.2, 530.1, 530.4, 594.3, 594.4

(56) References Cited

U.S. PATENT DOCUMENTS

| | | | | |
|---|---|---|---|---|
| 1,775,610 | * | 9/1930 | Weiss . | |
| 2,452,383 | * | 10/1948 | Markle, Jr. . | |
| 2,533,307 | * | 12/1950 | Amos et al. | 242/530.1 X |
| 2,585,999 | * | 2/1952 | Bunch . | |
| 2,656,127 | * | 10/1953 | Bunch . | |
| 2,815,905 | * | 12/1957 | Birchler et al. . | |
| 3,153,519 | * | 10/1964 | Jewell et al. . | |
| 4,325,518 | * | 4/1982 | Karr et al. . | |
| 4,629,140 | * | 12/1986 | LaCasse | 242/611.2 |
| 4,693,431 | * | 9/1987 | Kataoka . | |
| 4,978,083 | * | 12/1990 | Kim . | |
| 6,047,918 | * | 4/2000 | Saito | 242/611.2 X |

FOREIGN PATENT DOCUMENTS

| | | | | |
|---|---|---|---|---|
| 724295 | * | 8/1942 | (DE) | 242/611.2 |
| 1923180 | * | 11/1970 | (DE) | 242/599.4 |
| 2356245 | * | 6/1975 | (DE) | 242/611.2 |

* cited by examiner

*Primary Examiner*—William A. Rivera
(74) *Attorney, Agent, or Firm*—Arthur G. Yeager

(57) ABSTRACT

A self-locking core and shaft assembly includes an elongate generally cylindrical metal shaft having a plurality of spaced elongate upraised bosses extending substantially the entire length thereof. The spaced bosses define a plurality of spaced channels that also extend substantially the entire length of the shaft. The shaft carries an elongate hollow generally cylindrical core having a plurality of spaced inwardly projecting elongate bosses that extend substantially the entire length of the core and define a plurality of elongate spaced channels that also extend substantially the entire length of the core. The shaft and core are sized such that the core fits tightly on the shaft to inhibit rotary movement of the core with respect to the shaft. The core is made of material resistant to water absorption such as reinforced fiberglass or plastic. Hollow retaining rings and spacers are also provided and shaped to fit tightly onto the shaft which has longitudinal markings to assist in the proper positioning of the core and retaining rings and any spacers used.

24 Claims, 3 Drawing Sheets

SELF-LOCKING CORE AND SHAFT ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention refers to cores used for the winding and rewinding of products in the paper, textile, plastic and metal industries, and to core and shaft assemblies used in turn up operations in the papermaking industry.

2. Related Art

A wide variety of core and shaft assemblies are used in winding and storing products. It is common practice to use a fiber core and a pneumatically expandable shaft such as those manufactured by Tideland or Doublin which are high maintenance items requiring high initial costs. Fiber cores, however, have a relatively short lifetime and also have a tendency to absorb moisture from the air. This process can weaken the core and prevent proper operation of the shaft core assembly particularly where close tolerances are required. Finally, the core and shaft should be a self-locking assembly that provides for a minimal chance of slippage between the two under heavy loads. Improvements are needed in the prior art apparatus.

BRIEF SUMMARY OF THE INVENTION

In one aspect of the present invention there is provided a self-locking core and shaft assembly comprising an elongate generally cylindrical shaft having an exterior surface and opposite end portions, the shaft having a plurality of spaced laterally protruding first bosses formed in the exterior surface and extending longitudinally substantially the length of the shaft. The spaced first bosses define elongate first channels therebetween that extend substantially the length of the shaft. A hollow elongate generally cylindrical core has an interior surface and an exterior surface. The interior surface is formed of a plurality of inwardly protruding second bosses extending substantially the length of the core, which define second channels extending substantially the length of the core, which is sized to be tightly fitted over the shaft to minimize movement of the core with respect to the shaft. The shaft is formed of metal and the said core is formed of reinforced fiberglass or plastic or other material that resists absorption of water.

The assembly includes a pair of longitudinally extending axles mounted to respective end portions of the shaft. A securing means is mounted adjacent at least one end portion of the shaft to inhibit longitudinal movement of the core with respect to the shaft. The core is formed to be substantially equal in length to the shaft and includes distance markings thereon to assist in the placement of the core onto the shaft in a desired position along the shaft.

The assembly further includes at least one spacer for mounting adjacent one end portion of the core, the spacer including an elongate hollow generally cylindrical body having an interior surface having formed thereon a plurality of inwardly disposed spaced third bosses and extending substantially the length of the body. The third bosses define spaced third channels extending substantially the length of the body and are sized to fit within the third channels to provide that the spacer fits tightly onto the shaft to minimize rotary movement of the core with respect to the shaft. The outer diameter of the spacer body is less than the outer diameter of the core. The spacer is formed of material that is resistant to the absorption of water.

In other aspects of the present invention there is provided a self-locking core and shaft assembly comprising an elongate generally cylindrical shaft having an exterior surface and opposite end portions and a plurality of spaced laterally protruding first bosses formed in the exterior surface and extending longitudinally substantially the length of the shaft. The spaced first bosses define elongate first channels therebetween which extend substantially the length of the shaft. A hollow elongate generally cylindrical core has opposite end portions and has an interior surface and an exterior surface and is substantially the same length as the shaft. The interior surface has formed thereon a plurality of inwardly disposed second bosses that extend substantially the length of the core which define second channels extending substantially the length of the core. The first bosses fit into the second channels and the second bosses fit into the first channels to provide that the core fits tightly onto the shaft to minimize rotary movement of the core with respect to the shaft. The shaft is formed of metal and the core is formed of material that resists absorption of water. The assembly further includes securing means mounted to the shaft adjacent at least one end portion thereof to inhibit longitudinal movement of the core with respect to the shaft.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
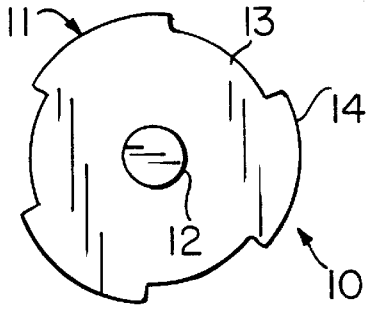
FIG. 1 is an end view of a core holder shaft in accord with the present invention.

With respect to the drawings, a shaft according to the present invention is shown at numeral 10 in FIG. 1. The core holder shaft 10 is an elongated generally cylindrical body 11 with an axle shaft 12 extending outwardly from the ends of body 11. The body 11 is preferably made of a suitably strong material such as aircraft aluminum in order to support the weight of a roll of paper or other material being processed in a particular application. Body 11 is formed to provide elongate bosses 14 that define channels 13.

Figure 2:
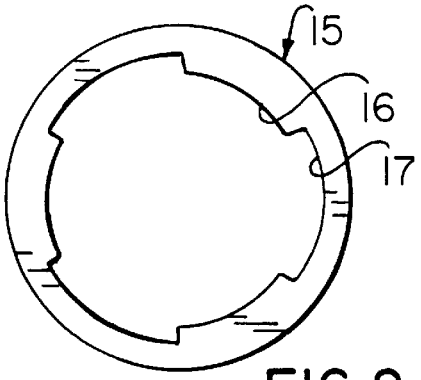
FIG. 2 is an end view of a core in accord with the present invention.

With reference to FIG. 2, a core 15 is an elongated generally cylindrical hollow member having inwardly projecting spaced apart raised bosses 16 that further define channels 17. Core 15 is preferably made of plastic, reinforced fiberglass, or similar material that is resistant to water absorption. Core 15 is sized to slide over shaft 10 in order to place bosses 14 within channels 17 and to place bosses 16 with channels 13. Both core holder shaft 10 and core 15 are sized to extend laterally across the width of the material, such as a web of paper, being rolled. Core 15 is sized internally to provide a tight fit between it and the outer surfaces of core holder shaft 10 in order to "lock" the two components together. The fit between shaft 10 and core 15 should be as tight as practically possible to prevent slippage or other undesirable movement during winding, rewinding, or lifting of the assembly via axle shafts 12.

Figure 3:
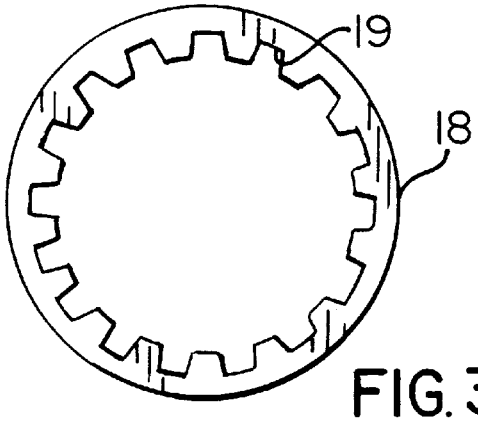
FIG. 3 is an end view of another embodiment of a core according to the present invention.
Figure 4:
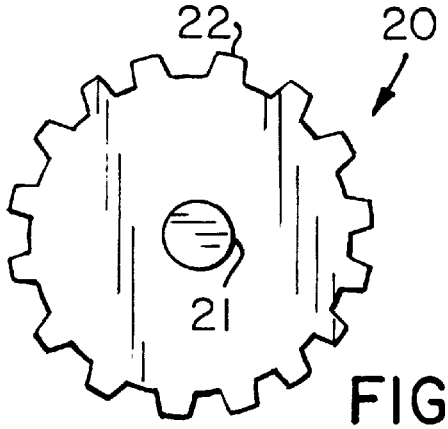
FIG. 4 is an end view of the shaft used with the core of FIG. 3.

FIGS. 3 and 4 illustrate an alternative shaft and core assembly. A hollow metal core holder shaft 20 has a plurality of upraised bosses formed generally as teeth 22 and an axle shaft 21. Hollow core 18 is formed to have inwardly extending teeth that define channels 19 that are complementary to teeth 22. Core 18 is preferably made of plastic or reinforced fiberglass to inhibit water absorption.

Figure 5:
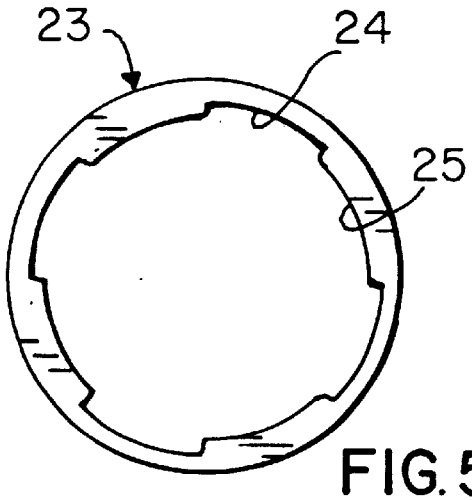
FIG. 5 is an end view of another embodiment of a core according to the present invention.
Figure 6:
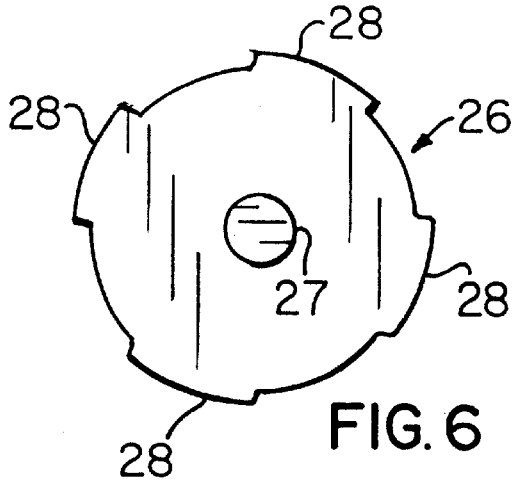
FIG. 6 is an end view of the shaft used with the core of FIG. 5.

FIGS. 5 and 6 illustrate another shaft and core assembly. Metal core holder shaft 26 has axle 27 and four spaced upraised bosses 28 that mate with interior spaced channels 24 of plastic or fiberglass core 23. Channels 24 are defined by inwardly extending bosses 25.

Figure 7:
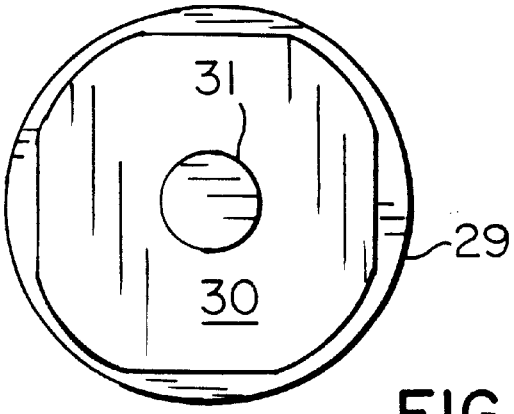
FIG. 7 is an end view of a core and shaft according to the present invention shown assembled.

FIG. 7 illustrates a further self locking assembly in assembled form. Metal core holder shaft 30 having axles 31 is mounted inside plastic or fiberglass core 29. In this embodiment the shaft 30 is generally square and has rounded corners.

The shaft and core assemblies of FIGS. 1–7 are designed to be self-locking. That is, the turning of the core holder shafts via their respective axles will result in the turning of the mounted core without any undesirable slippage or other movement between the shaft and core.

Figure 8:
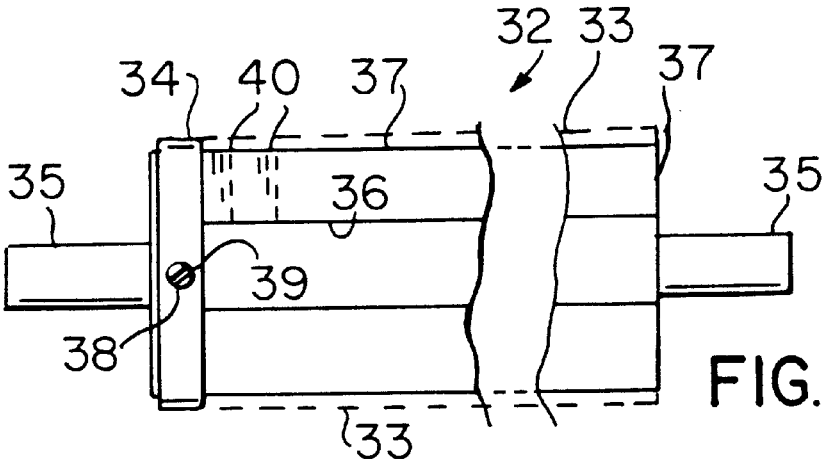
FIG. 8 is a side view of a shaft according to the present invention with a retaining ring in accord with the present invention attached thereto.

FIG. 8 illustrates another embodiment of the various core holder shaft and cores of FIGS. 1–7 showing the use of spacers for use in selected applications. Shaft 37 has channels 36 that represent the channel/boss structure of the shaft 37. Axles 35 are used to drive and lift the assembly. Core 33 is shown in broken line. A spacer or retaining ring 34 is mounted over the core 37 and held in place via set screw 39 through hole 38. The interior surface of ring 34 has the same geometry as does core 33 in order to fit tightly onto shaft 37.

Markings 40 provide for visual indication of placement of a core 33 onto the shaft 37 and can be used with any of the assemblies described herein. The markings 40 are preferably in feet measured from one end and include any desired subdivision markings.

Figure 9:
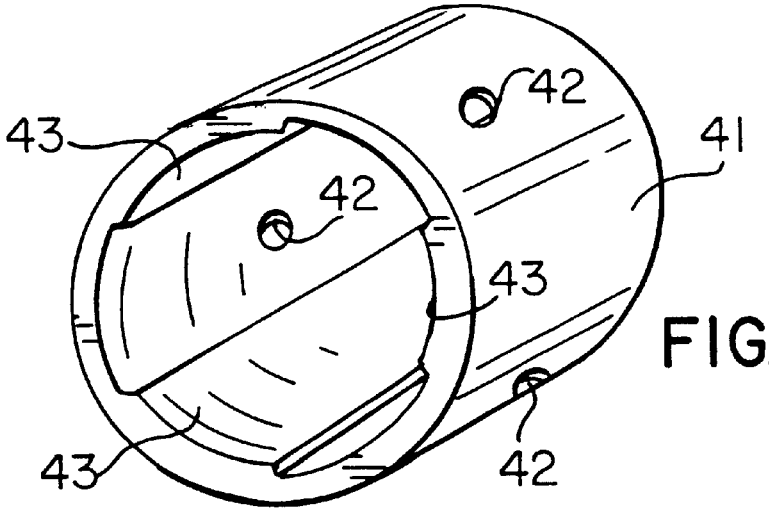
FIG. 9 is a perspective view of a core spacer in accord with the present invention.

With respect now to FIG. 9, a spacer 41 is illustrated having a plurality of holes 42 for set screws and interior raised surfaces to conform to a given core holder shaft geometry. The length of spacer 41 can be what is necessary for the proper positioning of a short core on a long shaft. In some applications a 10 ft. long core may be placed on a 20 ft. long shaft. Using markings 40 on the shaft, a core can be positioned centrally on the shaft for purposes of proper weight distribution. In such an example, two 5 ft. long spacers 41 may be used at either end of the core.

Figure 10:
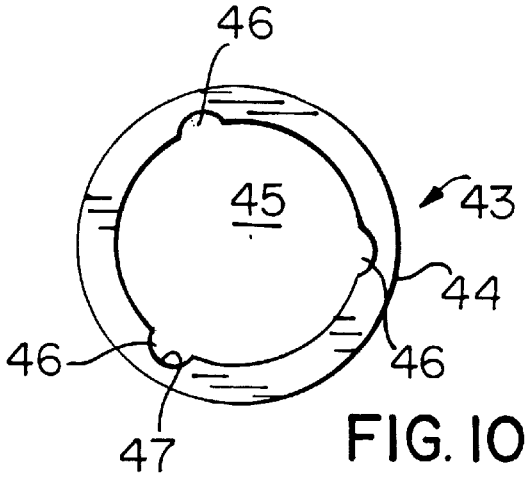
FIG. 10 is an end view of an alternative shaft and core in accord with the present invention.

FIG. 10 illustrates another embodiment of the present invention. Shaft and core assembly 43 includes shaft 44 onto which is mounted core 45 having three equally spaced bosses 46 internally to fit into three equally spaced channels 47 to create a self-locking assembly 43.

Figure 11:
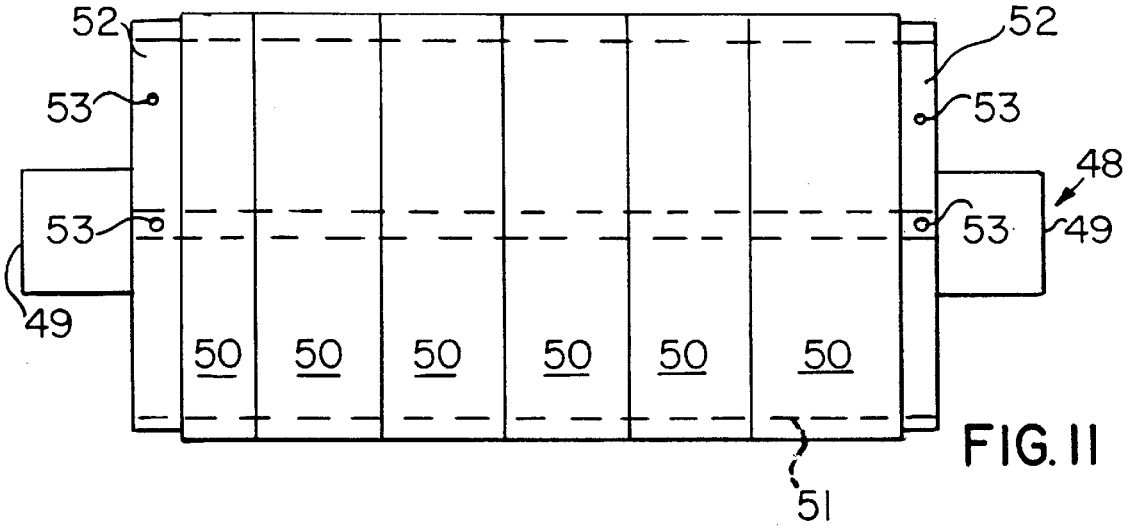
FIG. 11 is a side view of a shaft carrying multiple cores without spacers in accord with the present invention.

FIG. 11 illustrates an assembly 48 having drive axles 49 connected to shaft 51. A plurality of generally cylindrical core sections 50 are mounted side-by-side along the length of shaft 51. In this application, the sections 50 are mounted without the use of spacers. End rings 52 are held in place via screws 53. Any of the shaft and core assembly structures discussed hereinabove may be used in this embodiment. This embodiment is applicable to those usages where the material being wound up consists of parallel spools of tape, labels, or tickets and the like. In such applications the large web is often cut by knives positioned in line with edges of the core sections 50. It is important to note that the core sections 50 do not have to be of equal length (as measured along the shaft 51) depending upon the application and that the sections 50 do not necessarily have to extend the cumulative length of shaft 51.

The particular shaft and core assembly used will be determined in large measure by factors such as machine speed, the weight of the material being wound up, and other forces applied to the apparatus.

In addition, multiple cores, spacers 41, and rings 34 may be used in a particular application in any appropriate combination. The rings 34 and spacers 41 are preferably made of either plastic or steel depending upon the strength required for the force applied by the material being wound on the assembly. Finally, the rings 34 and spacers 41 will normally have an outside diameter slightly less than that of a core to prevent any interference between the items during system operations.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A self-locking core and shaft assembly comprising an elongate generally cylindrical solid shaft having an exterior surface and opposite end portions, said shaft having a plurality of spaced laterally protruding first bosses formed in said exterior surface and extending longitudinally substantially the length of said shaft, said spaced first bosses defining elongate first channels therebetween, said first channels extending substantially the length of said shaft, a hollow elongate generally cylindrical core having an interior surface and an exterior surface, said interior surface formed of a plurality of inwardly protruding second bosses extending substantially the length of said core, said spaced second bosses defining second channels extending substantially the length of said core, said core sized to be tightly fitted over and in contact with said exterior surface of said shaft to minimize movement of said core with respect to said shaft.

2. The assembly as defined in claim 1 wherein said shaft is formed of metal.

3. The assembly as defined in claim 1 wherein said core is formed of reinforced fiberglass.

4. The assembly as defined in claim 1 wherein said core is formed of plastic.

5. The assembly as defined in claim 1 wherein said core is formed of material that resists absorption of water.

6. The assembly as defined in claim 1 wherein said shaft is formed of metal and said core is formed of material that resists absorption of water.

7. The assembly as defined in claim 1 further including a pair of longitudinally extending axles mounted to respective said end portions of said shaft.

8. The assembly as defined in claim 1 further including securing means mounted adjacent at least one said end portion of said shaft to inhibit longitudinal movement of said core with respect to said shaft.

9. The assembly as defined in claim 1 wherein said core is formed to be substantially equal in length to said shaft.

10. The assembly as defined in claim 1 wherein said shaft includes distance markings thereon to assist in the placement of said core onto said shaft in a desired position along said shaft.

11. The assembly as defined in claim 1 further including at least one spacer for mounting adjacent said one end portion of said core, said spacer including an elongate hollow generally cylindrical body having an interior surface having formed thereon a plurality of inwardly disposed spaced third bosses and extending substantially the length of said body, said third bosses defining spaced third channels extending substantially the length of said body, said third bosses sized to fit within said first channels and said first bosses sized to fit within said third channels to provide that said spacer fits tightly onto said shaft to minimize rotary movement of said core with respect to said shaft.

12. The assembly as defined in claim 11 wherein the outer diameter of said spacer body is less than the outer diameter of said core.

13. The assembly as defined in claim 11 wherein said spacer is formed of material that is resistant to the absorption of water.

14. The assembly as defined in claim 1 wherein said core includes a plurality of core sections mounted side-by-side on said shaft.

15. The assembly as defined in claim 14 wherein said core sections are equal in length.

16. A self-locking core and shaft assembly comprising an elongate generally cylindrical solid shaft having an exterior surface and opposite end portions, said shaft having a plurality of spaced laterally protruding first bosses formed in said exterior surface and extending longitudinally substantially the length of said shaft, said spaced first bosses defining elongate first channels therebetween, said first channels extending substantially the length of said shaft, a hollow elongate generally cylindrical core having opposite end portions and having an interior surface and an exterior surface and being substantially the same length as said shaft, said interior surface having formed thereon a plurality of inwardly disposed second bosses that extend substantially the length of said core, said spaced second bosses defining second channels extending substantially the length of said core, said first bosses fitting into said second channels and said second bosses fitting into said first channels to provide that said core fits tightly onto and in contact with said exterior surface said shaft to minimize rotary movement of said core with respect to said shaft.

17. The assembly as defined in claim 16 wherein said shaft is formed of metal and said core is formed of material that resists absorption of water.

18. The assembly as defined in claim 16 further including a pair of longitudinally extending axles mounted to respective said end portions of said shaft for lifting and rotatably supporting said shaft.

19. The assembly as defined in claim 16 further including securing means mounted to said shaft adjacent at least one said end portion thereof to inhibit longitudinal movement of said core with respect to said shaft.

20. The assembly as defined in claim 19 wherein said securing means is formed of material resistant to the absorption of water.

21. The assembly as defined in claim 16 further including at least one spacer for positioning of said core onto said shaft, said spacer including an elongate hollow generally cylindrical body having an interior surface having formed thereon a plurality of inwardly disposed spaced third bosses extending substantially the length of said body, said third bosses defining spaced third channels extending substantially the length of said body, said third bosses sized to fit within said first channels and said first bosses sized to fit within said third channels to provide that said spacer fits tightly onto said shaft to minimize rotary movement of said core with respect to said shaft.

22. The assembly as defined in claim 21 wherein said shaft includes longitudinally spaced distance marking thereon to assist in the placement of said core and said spacer in desired position along said shaft.

23. A self-locking core and shaft assembly comprising an elongate generally cylindrical solid shaft having an exterior surface and opposite end portions, said shaft having at least one laterally protruding first boss extending longitudinally substantially the length of said shaft, a hollow elongate generally cylindrical core having an interior surface and exterior surface, said interior surface formed of at least one channel extending substantially the length of said core, said core sized to be tightly fitted over and in contact with said exterior surface of said shaft to minimize movement of said core with respect to said shaft.

24. The assembly as defined in claim 23 wherein said shaft is formed of metal and said core is formed of material that resists absorption of water.

* * * * *